US009761936B2

(12) United States Patent
Hwang et al.

(10) Patent No.: US 9,761,936 B2
(45) Date of Patent: Sep. 12, 2017

(54) PLANAR INVERTED-F ANTENNA

(71) Applicant: FOXCONN INTERCONNECT TECHNOLOGY LIMITED, Grand Cayman (KY)

(72) Inventors: Tzu-Yao Hwang, New Taipei (TW); Lung-Sheng Tai, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/810,725

(22) Filed: Jul. 28, 2015

(65) Prior Publication Data

US 2016/0036129 A1 Feb. 4, 2016

(30) Foreign Application Priority Data

Jul. 30, 2014 (TW) ..... 103213468 U

(51) Int. Cl.
*H01Q 1/48* (2006.01)
*H01Q 9/04* (2006.01)
*H01Q 5/371* (2015.01)

(52) U.S. Cl.
CPC ..... *H01Q 1/48* (2013.01); *H01Q 9/0421* (2013.01); *H01Q 5/371* (2015.01)

(58) Field of Classification Search
CPC ..... H01Q 9/045; H01Q 1/48
USPC ..... 343/848
See application file for complete search history.

(56) References Cited

U.S. PATENT DOCUMENTS 6,404,394 B1 * 6/2002 Hill ..... H01Q 1/243 343/700 MS
2009/0153407 A1 * 6/2009 Zhang ..... H01Q 1/243 343/702
2010/0079351 A1 * 4/2010 Huang ..... H01Q 1/48 343/846

* cited by examiner

*Primary Examiner* — Dameon E Levi
*Assistant Examiner* — Andrea Lindgren Baltzell
(74) *Attorney, Agent, or Firm* — Wei Te Chung; Ming Chieh Chang

(57) ABSTRACT

A planar inverted-F antenna includes an antenna body including a grounding portion, a first and a second radiating arm extending in a lengthwise direction substantially, a coaxial cable and a metal foil attached the grounding portion. The first radiating arm and the second radiating arm extend in opposite directions from a joint point thereof, the joint point and the grounding portion connect with each other by a connecting portion. A first slot is defined between the first radiating arm and the grounding arm, a second slot is defined between the second radiating arm and the grounding portion. A coaxial cable includes a core soldered to the joint point and a shielding layer soldered to the grounding portion. The metal foil covers a most portion of the grounding portion, thereby exposes a first end of the grounding portion near to the first radiating arm to an exterior.

18 Claims, 4 Drawing Sheets

PLANAR INVERTED-F ANTENNA

BACKGROUND OF THE INVENTION

1. Field of the Invention

The present disclosure relates to a planar inverted-F antenna.

2. Description of Related Art

Miniaturization is a trend for portable electronic devices. Thus, components inner the portable electronic devices become thinner and smaller. Antenna, a necessary component in wireless communicating device, is manufactured to be smaller and lower. The space between the antenna and other components become smaller and smaller. Planar Inverted-F Antenna (PIFA) is a type of often-used antenna inner electronic devices. A typical PIFA always comprises a feed point and two radiating portions extending apart from each other from the feed point for working at different frequency bands. However, as the space between the PIFA and the other components is very small, the other components have negative impacts on the antenna, so that the antenna has a bad performance and fails to cover a broader band. Moreover, manufactures send the antennas a qualifications lab to make a performance test, which will waste cost and time.

In view of the above, an improved antenna is desired to overcome the problems mentioned above.

SUMMARY OF THE INVENTION

Accordingly, an object of the present disclosure is to provide a planar inverted-F antenna.

According to one aspect of the present disclosure, a planar inverted-F antenna comprises an antenna body comprises a grounding portion, a first radiating arm and a second radiating arm extending in a lengthwise direction substantially, and a coaxial cable and a metal foil attached the grounding portion. The first radiating arm and the second radiating arm extend in opposite directions from a joint point thereof, the joint point and the grounding portion connect with each other by a connecting portion. A first slot is defined between the first radiating arm and the grounding arm, a second slot is defined between the second radiating arm and the grounding portion. A coaxial cable comprises a core soldered to the joint point and a shielding layer soldered to the grounding portion. The metal foil covers a most portion of the grounding portion, thereby exposes a first end of the grounding portion near to the first radiating arm to an exterior.

Other objects, advantages and novel features of the disclosure will become more apparent from the following detailed description when taken in conjunction with the accompanying drawings, in which:

DETAILED DESCRIPTION OF THE INVENTION

Reference will now be made to the drawings to describe a preferred embodiment of the present disclosure in detail.

Figure 1:
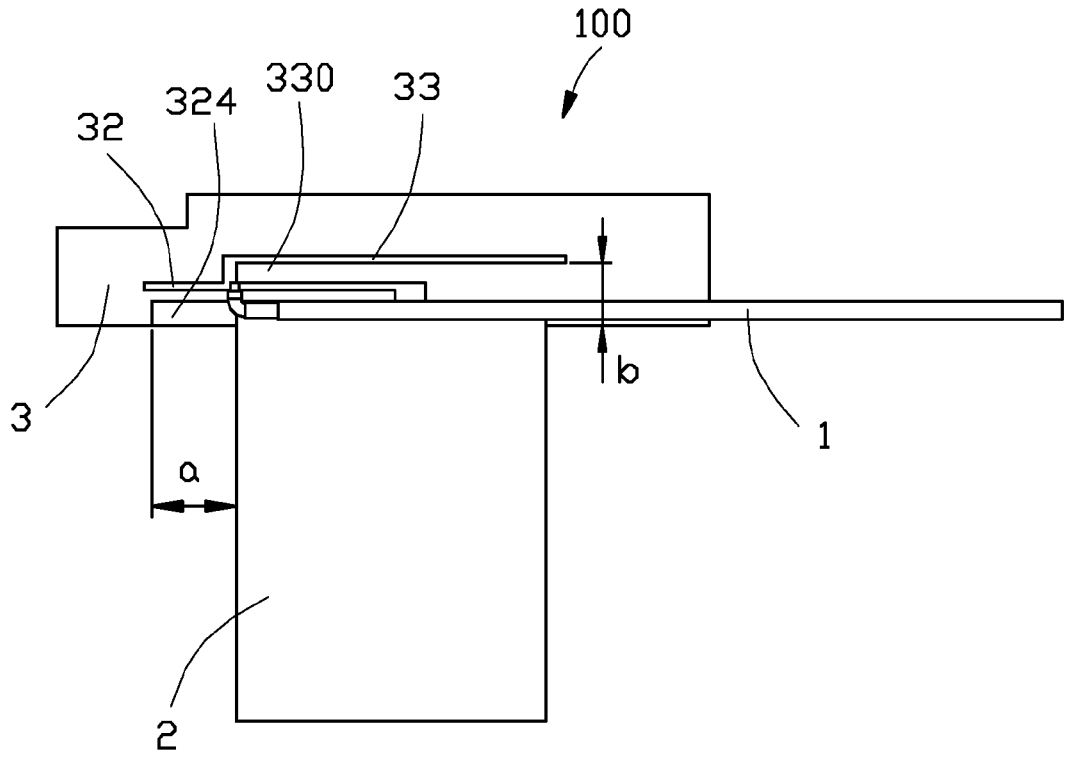
FIG. 1 is a front elevational view of a planar inverted-F antenna in accordance with a preferred embodiment of the present disclosure.
Figure 2:
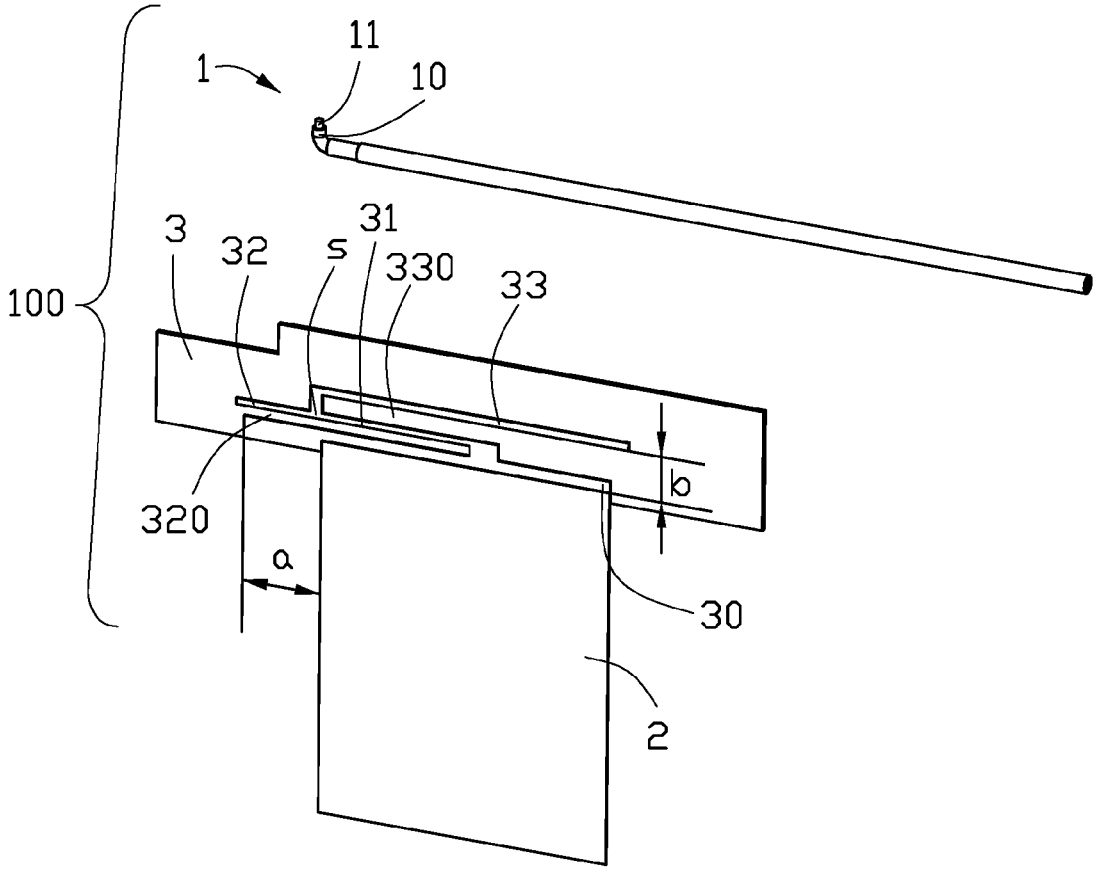
FIG. 2 is a front exploded perspective view of the antenna shown in FIG. 1.
Figure 3:
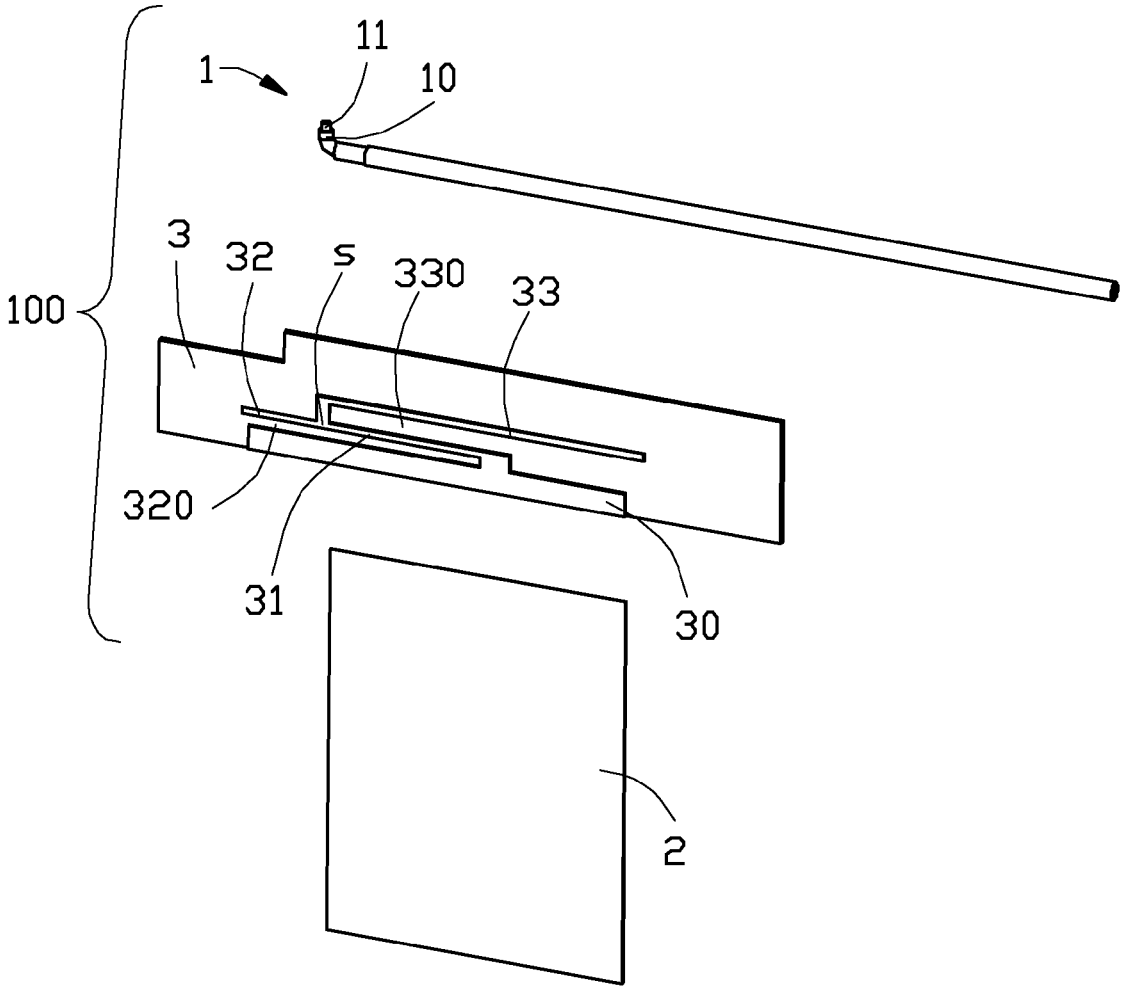
FIG. 3 is a further exploded perspective view of the antenna shown in FIG. 2.
Figure 4:
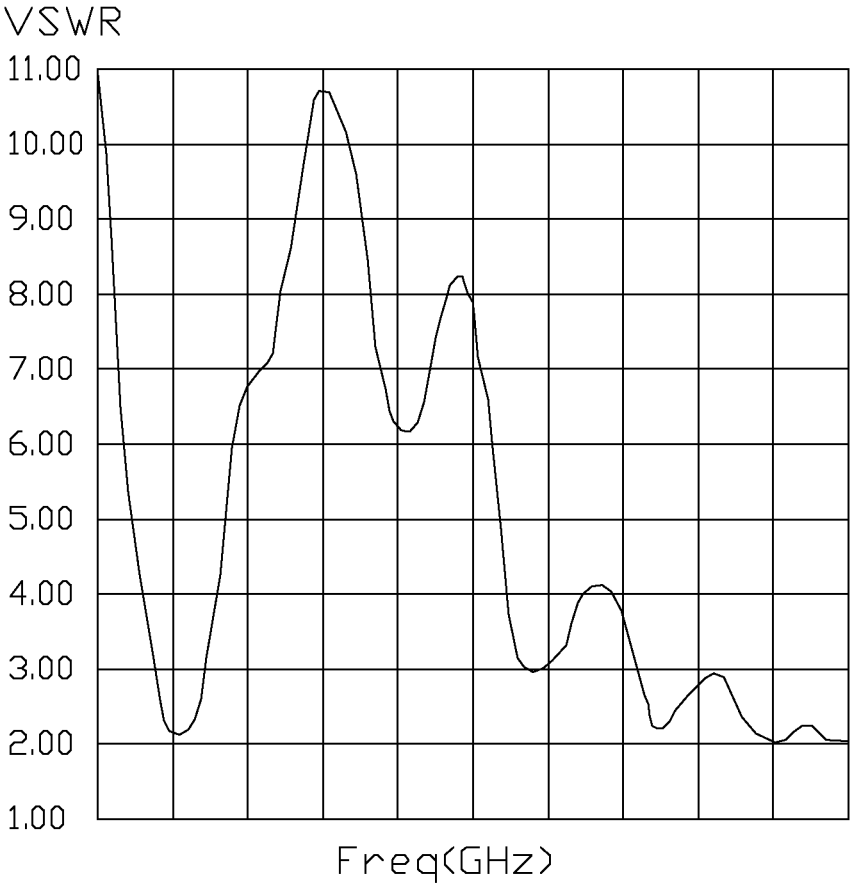
FIG. 4 is a graph showing a voltage standing wave ratio (VSWR) of the antenna of FIG. 1.

Referring to FIG. 1 and FIG. 2, a planar inverted-F antenna 100 in accordance with the preferred embodiment of the present disclosure, comprises an antenna body 3 extending in a lengthwise direction, a metal foil 2 and a coaxial cable 1 connecting with the antenna body 3. The antenna body 3 comprises a grounding portion 30 extending in the lengthwise direction and a connecting portion 31 extending from the grounding portion 30. A first radiating arm 33 and a second radiating arm 33 extend in opposite directions from a same lengthwise end S of the connecting portion 31. The first radiating arm 32 and a second radiating arm 33 extend in the lengthwise direction substantially, and the connecting portion 31 is parallel to the grounding portion 30.

A first slot 320 is defined between the first radiating arm 32 and the grounding portion 30 and a second slot 330 is defined between the second radiating arm 33 and the grounding portion 30. The width of the first slot 320 perpendicular to the lengthwise direction equals to 0.68 mm in a vertical direction. The second slot 330 has a larger width than the first slot in the vertical direction. Notably, the second slot 330 defines two different vertical dimensions along the lengthwise direction, and both two different vertical dimensions/widths are larger than the width of the first slot 320. The first radiating arm 32 works on a higher frequency band 5 GHz, and the second radiating arm 33 works on a lower frequency band 2.4 GHz.

The coaxial cable 1 comprises a conductive core 11 soldered to said lengthwise end S, i.e. a joint point or a signal feeder point, and a shielding layer 10 soldered to the grounding portion 30. The feeder point is disposed at the joint of he first and the second radiating arm. The metal foil 2 is attached the grounding portion 30. Please notes, the metal foil 2 cover a most portion of the grounding portion 30, thereby exposing a first end 324 of the grounding portion near to the first radiating arm 30 to an exterior. An outmost edge of the metal foil 2 is aligned with a second end opposite to the first end 324 of the grounding portion. As best shown in FIG. 1, during qualified test, the metal foil can be re-attached to control the distance a to adjust the antenna efficiency of the good higher frequency band and the distance b is to adjust the antenna efficiency of the lower frequency band.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. A planar inverted-F antenna comprising:

an antenna body comprising a grounding portion, a first radiating arm and a second radiating arm extending in a lengthwise direction substantially, the first radiating arm and the second radiating arm extending in opposite directions from a joint point thereof, the joint point and the grounding portion connecting with each other by a connecting portion;

a first slot defined between the first radiating arm and the grounding arm a second slot defined between the second radiating arm and the grounding portion;

a coaxial cable comprising a core soldered to the joint point and a shielding layer soldered to the grounding portion;

a metal foil attached the grounding portion;

wherein the metal foil covers most areas of the grounding portion, thereby exposes a first end of the grounding portion near to the first radiating arm to an exterior portion of the antenna body.

2. The planar inverted-F antenna as claimed in claim 1, wherein the first slot has a width between the first radiating arm and the grounding portion with 0.68 mm.

3. The planar inverted-F antenna as claimed in claim 2, wherein the second slot has a larger width than the first slot.

4. The planar inverted-F antenna as claimed in claim 1, wherein an outmost edge of the metal foil is aligned with a second end opposite to the first end of the grounding portion.

5. The planar inverted-F as claimed in claim 4, wherein the connecting portion is parallel to the grounding portion.

6. A planar inverted-F antenna comprising:

an antenna body comprising a lengthwise grounding portion having opposite first and second end along a lengthwise direction, a first radiating arm extending from a joint point in a first orient of the lengthwise direction, and a second radiating arm extending from the joint point in a second orient of the longwise direction opposite to the first orient, thereby a first slot being defined between the first radiating arm and the grounding portion and a second slot defined between the second radiating arm and the grounding portion, the joint point and the grounding portion connecting with each other by a connecting portion;

a coaxial cable comprising a core soldered to the joint point and a shielding layer soldered to the grounding portion;

a metal foil attached to the grounding portion;

wherein the metal foil covers most areas of the grounding portion and exposes a first end of the grounding portion near to the first radiating arm to an exterior portion of said antenna body.

7. An antenna comprising:

an antenna body including:

a grounding portion extending along a lengthwise direction;

an L-shaped connection portion extending from an upper edge of the grounding portion essentially along the lengthwise direction;

a first radiating arm extending from an end of the connecting portion along the same lengthwise direction with the connection portion;

an L-shaped second radiating arm extending from said end of the connecting portion essentially along an opposite lengthwise direction;

the first radiating arm and the connecting portion being essentially located between the grounding portion and the second radiating arm in a vertical direction perpendicular to said lengthwise direction;

a metallic foil attached to the grounding portion extending in the vertical direction opposite to all said connecting portion, said first radiating arm and said second radiating arm; and a coaxial cable including an inner conductor mechanically and electrically connected essentially at said end of the connecting portion, and an outer conductor mechanically and electrically connected to the metallic foil; wherein the metallic foil is essentially located under the second radiating arm, and a first distance along the lengthwise direction between an end of the grounding portion and a side edge of the metallic foil determines a high frequency performance, while a second distance in the vertical direction between the second radiating arm and an upper edge of the metallic foil determines a lower frequency performance; wherein the end of the grounding portion is located under the first radiating arm, and the side edge of the metallic foil is located under the second radiating arm and close to the end of the connecting portion.

8. The antenna as claimed in claim 7, wherein a dimension of the metallic foil along said lengthwise direction is smaller than that of the grounding portion.

9. The antenna as claimed in claim 8, wherein the metallic foil is within a boundary of the grounding portion in said lengthwise direction.

10. The antenna as claimed in claim 7, wherein an end of the first radiating arm extends beyond said end of the grounding portion in said lengthwise direction.

11. The antenna as claimed in claim 7, wherein an end of the second radiating arm extends in said opposite lengthwise direction beyond another end of the grounding portion.

12. The antenna as claimed in claim 7, wherein a dimension of the first radiating arm is smaller than that of the connection portion in the lengthwise direction.

13. The antenna as claimed in claim 12, wherein a dimension of the connecting portion is smaller than that of the second radiating arm in the lengthwise direction.

14. The planar inverted-F antenna as claimed in claim 1, wherein said connecting portion forms an L-shaped structure having a horizontal section which extends at a same level with the first radiating arm.

15. The planar inverted-F antenna as claimed in claim 3, wherein said second slot directly downwardly communicates with the grounding portion in a vertical direction.

16. The planar inverted-F antenna as claimed in claim 1, wherein all the antenna body extends in a common plane.

17. The planar inverted-F antenna as claimed in claim 6, wherein all the antenna body extends in a common plane.

18. The planar inverted-F antenna as claimed in claim 7, wherein all the antenna body extends in a common plane.

* * * * *